US006038974A

United States Patent [19]

Richards

[11] Patent Number: 6,038,974

[45] Date of Patent: Mar. 21, 2000

[54] GRIPPER DECELERATION CROSS FOLDER

[75] Inventor: John S. Richards, Barrington, N.H.

[73] Assignee: Heidelberger Druckmaschinen AG, Heidelberg, Germany

[21] Appl. No.: 09/186,435

[22] Filed: Nov. 5, 1998

[51] Int. Cl.[7] ..... B65H 5/10; B41F 1/08; B42C 1/00

[52] U.S. Cl. ..... 101/232; 270/4; 270/49; 493/429; 493/359

[58] Field of Search ..... 101/230, 232, 101/409; 270/4, 12, 32, 49, 51, 45; 493/424, 425, 426, 427, 428, 429, 356, 359

[56] References Cited

U.S. PATENT DOCUMENTS

| | | | |
|---|---|---|---|
| 3,960,079 | 6/1976 | Capetti | 101/232 |
| 4,357,870 | 11/1982 | Rudolph et al. | 101/409 |
| 4,682,767 | 7/1987 | Littleton | 270/45 |
| 5,102,111 | 4/1992 | Reponty | 270/12 |
| 5,242,367 | 9/1993 | Marmin | 493/359 |
| 5,429,579 | 7/1995 | Nishihara | 493/359 |
| 5,494,270 | 2/1996 | Laubscher | 270/49 |
| 5,794,929 | 8/1998 | Curley et al. . | |

*Primary Examiner*—Eugene Eickholt
*Attorney, Agent, or Firm*—Kenyon & Kenyon

[57] ABSTRACT

A gripper deceleration cross folder device having a rotatably mounted jaw cylinder including a plurality of jaw devices, a rotatably mounted gripper decelerator drum forming a nip with the jaw cylinder, and a plurality of gripper decelerator devices mounted on the gripper decelerator drum, each gripper decelerator for gripping and decelerating one of a plurality of signatures at a time. A respective tucking device corresponding to each of the plurality of gripper decelerator devices for tucking each one of the signatures into a corresponding one of the plurality of jaw devices after the decelerating of the signature so as to fold the signature.

18 Claims, 1 Drawing Sheet

GRIPPER DECELERATION CROSS FOLDER

FIELD OF THE INVENTION

The present invention relates to a folder in a printing press, and more specifically to a gripping, decelerating cross folder.

RELATED TECHNOLOGY

Prior cross folders use pins or grippers to hold a signature to a tucking cylinder until the area of the signature to be cross folded is aligned with a jaw of a jaw cylinder. The signature is tucked into the jaw, forming a cross fold. The folded signature is carried in the jaw by the jaw cylinder to a point of release, the pins or jaws in the tucking cylinder having released the leading edge of the signature. Typically the speed of the signature and the surface speeds of the tucking cylinder and the jaw cylinder are roughly equal, enabling the transfer of the signature from the tucking cylinder to the jaw cylinder to occur.

At relatively low speeds, jaw and/or tucking cylinders may require, for example, only three parts; that is, a cylinder may be sized to that folding operations take place sequentially on 120° segments of the cylinder. As higher speed operation has been attempted, the cylinders have had to be larger in diameter to minimize the curvature that the faster moving signatures experience. At higher speeds, for example, the cylinders may have five parts so that folding operations take place sequentially on 72° segments of the cylinders. Such a five part configuration entails the extra cost of two additional folding mechanisms, as well as a 67% increase in each cylinder diameter.

Higher speeds of signature travel require an intermediate slowdown of the signatures before subsequent operations, such as chopper folding, can occur. Prior methods for accomplishing such slowdowns include slowdown cylinders and belt slowdown devices. Higher speed operations often require two choppers receiving alternating signatures to achieve the required speeds. Separate slowdown devices may be required for each chopper.

Higher speed folding operations thus entail additional costs, as well as increased equipment size and complexity.

SUMMARY OF THE INVENTION

The present invention provides a gripper deceleration cross folder device including a rotatably mounted jaw cylinder having a plurality of jaw devices, a rotatably mounted gripper decelerator drum engaging the jaw cylinder at a nip, and a plurality of gripper decelerator devices mounted on the gripper decelerator drum. Each gripper decelerator device grips and decelerates one of a plurality of signatures at a time. A respective tucking device corresponding to each of the plurality of gripper decelerator devices is included. The respective tucking device tucks each of the signatures into a corresponding one of the jaw devices after the signature has been decelerated.

The present invention also provides a method for decelerating and folding a plurality of signatures. The method includes gripping and decelerating the plurality of signatures using a rotatably mounted gripper decelerator drum having a plurality of gripper decelerator devices for gripping and decelerating the signatures. The method also includes folding, after decelerating, each of the signatures by tucking each of the signatures into a respective jaw device of a jaw cylinder using a respective tucking device corresponding to each gripper decelerator device.

According to a device and method of the present invention, the signatures overlap each other on the gripper decelerator drum due to the deceleration. The overlapping enables an increased cross folder duty cycle, as well as permits chopping of the signatures in groups and release of the signatures in groups to two or more locations for subsequent folding operations.

The present invention permits higher operating speeds to be achieved without the increased expense, size and complexity associated with increasing the number of parts around the folding cylinders.

BRIEF DESCRIPTION OF THE DRAWINGS

In the following, the present invention is explained in more detail with the aid of the drawings, in which.

DETAILED DESCRIPTION

Figure 1:
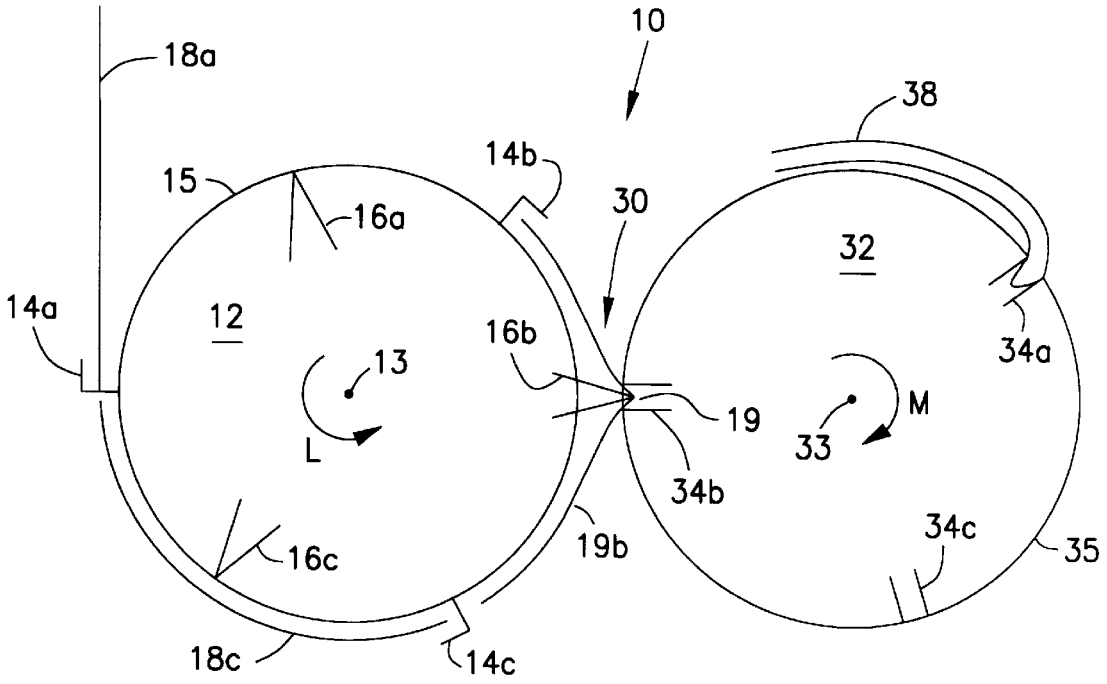
Fig. 1 Prior Art
FIG. 1 shows a cross-sectional schematic view of a prior cross folder.
Figure 2:
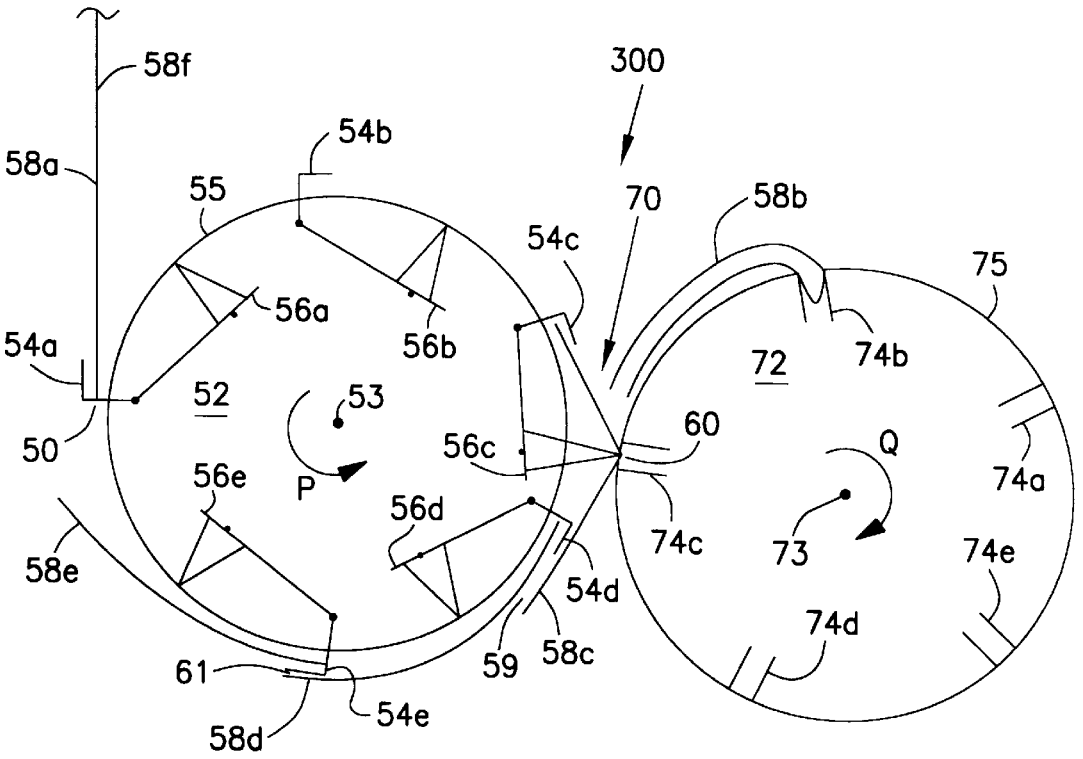
FIG. 2 shows a cross-sectional schematic view of a gripper deceleration cross folder according to the present invention.

To better understand the present invention, which is shown in FIG. 2, a prior art folding device is described in FIG. 1.

FIG. 1 shows a cross-sectional schematic view of a prior art cross folder 10 having tucking cylinder 12 and jaw cylinder 32. Tucking cylinder 12 and jaw cylinder 32, which are rotatably mounted on axes 13 and 33 respectively, form a nip 20. Tucking cylinder 12 rotates at a constant rate about axis 13 in the direction indicated by the arrow "L," while jaw cylinder 32 rotates at a constant rate about axis 33 in the direction indicated by the arrow "M" so that the surface speeds of cylinders 12 and 32 are approximately equal at nip 20.

Tucking cylinder 12 has grippers 14*a,* 14*b* and 14*c* equally spaced around circumferential surface 15 which travel with edge 15 as tucking cylinder 12 rotates about axis 13. Grippers 14*a,* 14*b* and 14*c* engage, or grip, incoming signatures 18*a,* 18*b* and 18*c,* respectively, and carry the signatures around with circumferential surface 15. Tucking cylinder 12 also has tucking blades 16*a,* 16*b* and 16*c* associated with grippers 14*a,* 14*b* and 14*c,* respectively. Tucking blades 16*a,* 16*b* and 16*c* travel with circumferential surface 15 as tucking cylinder 12 rotates about axis 13. Jaw cylinder 32 has jaws 34*a,* 34*b* and 34*c* equally spaced around circumferential edge 35 which travel with circumferential edge 35 as jaw cylinder 32 rotates about axis 33. Jaws 34*a,* 34*b* and 34*c* receive the folded signatures and carry the signatures around circumferential edge 35.

In operation of prior folder 10, an incoming individual signature 18*a* is engaged by gripper 14*a* and, as tucking cylinder 12 rotates about axis 13, the signature is carried with circumferential edge 15 toward nip 30. At nip 30, as shown for signature 16*b,* for example, tucking blade 16*b* extends toward opposing jaw 34*b* on jaw cylinder 32, jaw 34*b* having been brought to nip 30 by the rotation of jaw cylinder about axis 33. Signature 18*b* is in this way tucked into jaw 34*b* resulting in cross fold 19. As jaw cylinder continues to rotate, jaw 34*b,* which engages signature 18*b,* carries the signature with circumferential edge 38. A previously folded and engaged signature 38 is depicted in FIG. 1 being carried by jaw 34*a*. Jaws 34*a,* 34*b* and 34*c* eventually release their respective signatures for further processing. Jaw 34*c,* for example, is depicted empty, having already released its respective signature.

Increasing the processing speed of a prior folder such as folder 10, generally requires increasing the number of tucking blades 16 and jaws 34, so that more signatures are folded per cylinder rotation. Also, the diameters of tucking cylinder 12 and jaw cylinder 32 typically must be increased to accommodate the additional folding segments.

FIG. 2 shows a cross sectional schematic view of a gripper deceleration cross folder 100 according to an embodiment of the present invention. Cross folder 100 includes gripper decelerator drum 52 and jaw cylinder 72, which rotate about axes 53 and 73, respectively, and form nip 70. Gripper decelerator drum 52 rotates about axis 53 in a direction indicated by arrow "P," while jaw cylinder 72 rotates about axis 73 in a direction indicated by arrow "Q."

As embodied herein gripper decelerator drum 52 includes five gripper decelerators 54*a,* 54*b,* 54*c* and 54*d* and 54*e.* A tucking blade 56*a,* 56*b,* 56*c,* 56*d* and 56*e* is associated with each of gripper decelerators 54*a,* 54*b,* 54*c* and 54*d* and 54*e,* respectively.

As embodied herein jaw cylinder 72 includes five jaws 74*a,* 74*b,* 74*c,* 74*d* and 74*e.* Jaws 74 move with circumferential edge 75 of jaw cylinder 72 as the jaw cylinder rotates about axis 73.

Each gripper decelerator 54 is constructed to engage, or grip, an incoming signature 58, carry the signature with circumferential edge 55 of gripper decelerator drum 52 while decelerating the signature to a lower speed at nip 70, release the signature, then accelerate to engage a subsequent incoming signature 58. Each gripper decelerator 54 is designed to operate in concert with the diameter and rotational speed of gripper decelerator drum 52 so that the speed at nip 70 of a signature 58 carried by the gripper decelerator 54 is substantially equal to the speed of a jaw 74 at nip 70 to enable a smooth tucking operation. A gripper decelerator 54 preferably decelerates an incoming signature 58 to 60% of its incoming speed, but in other embodiments of the present invention an incoming signature may be decelerated by other amounts appropriate to the sizes, configurations and speeds of gripper decelerator drum 52 and jaw cylinder 72.

Each gripper decelerator 54 may be a rotary gripper of a type described in U.S. Pat. No. 5,794,929, which is hereby incorporated by reference herein. As described therein, a variable velocity profile may be imparted to a plurality of signatures using rotary gripper devices mounted on a drum. In other embodiments of the present invention gripper decelerators 54 may each be any other suitable device for gripping and decelerating a signature.

Tucking blades 56*a,* 56*b,* 56*c,* 56*d* and 56*e* preferably are connected to associated gripper decelerators 54*a,* 54*b,* 54*c* and 54*d* and 54*e,* respectively, so that the tucking blades decelerate and accelerate with their respective gripper decelerator.

In operation of gripper deceleration cross folder 100, as depicted in FIG. 2, an incoming signature 58*a* moving at a relatively high initial speed is engaged by gripper decelerator 54*a* at pick up point 50. Previous incoming, signatures 58*c,* 58*d* and 58*e* are depicted as having been previously engaged by gripper decelerators 54*c,* 54*d* and 54*e,* respectively. Each of signatures 58 is decelerated by its respective gripper decelerator 54 from the initial high speed at pick up point 50 to a lower speed at nip 70 substantially equal to the speed of a jaw 74 of jaw cylinder 72. As embodied herein, gripper decelerators 54 decelerate and "bunch up" as they near nip 70, as shown in FIG. 2. Gripper decelerator 54*d* is thus depicted nearer to gripper decelerator 54*c* than gripper decelerator 54*e* is to gripper decelerator 54*d,* while gripper decelerator 54*e* is even farther from gripper decelerator 54*a*. The deceleration of signatures 58 results in overlapping of successive signatures, as exemplified in FIG. 2 by overlap areas 59 and 61 between signatures 58*c* and 58*d,* and between signatures 58*d* and 58*e,* respectively.

When a tucking blade 56 associated with a particular gripper decelerator 54 is aligned with a jaw 74 of jaw cylinder 72, tucking blade 56 extends to tuck signature 58 held by gripper decelerator 54 into jaw 74 to fold the signature. For example, tucking blade 56*c* associated gripper decelerator 54*c* is shown aligned with a jaw 74*c* of jaw cylinder 72 and tucking signature 58*c* into jaw 74*c* to form cross fold 60. During each signature folding operation, the gripper decelerator 54 involved releases its signature 58, and the jaw 74 involved engages the signature, carrying the signature away as jaw cylinder 72 continues to rotate about axis 73. For example, in FIG. 2, jaw 74*b* is depicted carrying away previously folded signature 58*b,* while gripper decelerator 54*b* is shown empty, having released signature 58*b* to jaw 74*b*.

At a predetermined point in the rotation of jaw cylinder 72, a jaw 74 releases its folded signature 58 for subsequent folding, chopping, etc. operations. For example, FIG. 2 shows jaw 74*a* empty, having previously released a folded signature 58. Because of the relatively close spacing of folded signatures 58 due to the overlapping at gripper decelerator drum 52, the folded signatures may advantageously be released by jaws 74 in groups for chopping, or in groups to two or more locations for subsequent folding operations, etc.

After a gripper decelerator 54 releases its signature 58 in the folding operation, the empty gripper decelerator continues to move with gripper decelerator drum 52. At the same time the empty gripper decelerator accelerates relative to gripper decelerator drum 52 from nip 70 to pick up point 50, where it engages an incoming high speed signature 58. For example, FIG. 2 shows empty gripper decelerator 54*b* as it accelerates to engage incoming signature 58*f.* As gripper decelerators 54 accelerate from nip 70 to pick up point 50, they spread out from each other, as exemplified by gripper decelerators 54*c,* 54*b* and 54*a* in FIG. 2.

The gripper deceleration cross folder according to the present invention affords several advantages. For example, deceleration of the signatures takes place prior to cross folding. No intermediate slowdowns are necessary prior to subsequent operations. Also, because the signatures have already been decelerated prior to cross folding, jaw cylinder 72 may rotate at a slower surface speed than a prior jaw cylinder folding undecelerated signatures, but with the same folded signature throughput. Jaw cylinder 72 need thus only be configured with its parts closer together than they would normally be when the two cylinders rotate at the same speed, as in the prior art. The deceleration of signatures 58 also permit gripper decelerator drum 52 and jaw cylinder 72 to have smaller diameters—and thus smaller volumes—than would normally be required to minimize signature curvature at high operating speeds.

Additional advantages result from the overlapping of the signatures on gripper decelerator drum 52. After transfer to jaw cylinder 72, the signatures are spaced around the circumference 75 of the jaw cylinder more closely than with typical prior jaw cylinders. This closer spacing permits an increased cross folder duty cycle. A nominal prior signature spacing might be, for example, a space between successive signatures approximately equal to the length of a signature, resulting in a 50% duty cycle. With the gripper deceleration cross folder according to the present invention, a deceleration of the signature to 60%, for example, of its incoming speed results in a removal of 40% of the space between successive signatures. The resulting duty cycle may be calculated to be 60% of 50%, or a 83% duty cycle. The more closely spaced signatures are suitable for chopping in groups or for being released in groups to two or more locations for subsequent folding operations, as previously noted.

Various changes may be made to the embodiments of the present invention herein described without departing from the scope of the present invention. For example, gripper decelerator drum 52 may be provided with different numbers and types of gripper decelerators 54 and tucking blades 56. Likewise, jaw cylinder 72 may be provided with different numbers and types of jaws. Additionally, various signature 58 deceleration amounts, as well as gripper deceleration drum 52 and jaw cylinder 72 speeds may be used to achieve signature speeds at nip 70 appropriate for the size and configuration of gripper deceleration drum 52 and jaw cylinder 72. These and other variations are intended to be within the present invention, whose scope is only intended to be limited by the claims which follow.

What is claimed is:

1. A gripper deceleration cross folder device comprising:

a rotatably mounted jaw cylinder including a plurality of jaw devices;

a rotatably mounted gripper decelerator drum forming a nip with the jaw cylinder;

a plurality of gripper decelerator devices mounted on the gripper decelerator drum, the plurality of gripper decelerator devices for gripping and decelerating signatures; and a respective tucking device corresponding to each of the plurality of gripper decelerator devices.

2. The gripper deceleration cross folder device as recited in claim 1 wherein each of the respective tucking device is connected to its corresponding gripper decelerator device.

3. The gripper deceleration cross folder device as recited in claim 1 wherein the jaw cylinder and the gripper decelerator drum rotate so that a surface speed of the jaw cylinder substantially matches a speed of each respective tucking device at a point of transfer.

4. The gripper deceleration cross folder device as recited in claim 1 wherein the plurality of gripper decelerator devices decelerate the signatures so that the signatures overlap.

5. The gripper deceleration cross folder device as recited in claim 1 wherein the plurality of gripper decelerator devices includes five gripper decelerator arms disposed around a circumference of the gripper decelerator drum.

6. The gripper deceleration cross folder device as recited in claim 1 wherein each respective tucking device includes a tucking blade disposed at a predetermined distance from the corresponding gripper decelerator device.

7. The gripper deceleration cross folder device as recited in claim 1 wherein each one of the plurality of signatures are decelerated by substantially 40%.

8. The gripper deceleration cross folder device of claim 4 wherein the plurality of jaw devices are configured to release the signatures in groups to at least two locations for subsequent folding operations.

9. The gripper deceleration cross folder device of claim 4 wherein the plurality of jaw devices are configured to release the signatures in groups for chopping in the groups.

10. A method for decelerating and folding a plurality of signatures, the method comprising:

gripping and decelerating the plurality of signatures using a rotatably mounted gripper decelerator drum including a plurality of gripper decelerator devices, each gripper decelerator for gripping, and decelerating one of the plurality of signatures at a time; and folding, after the decelerating, each of the plurality of signatures by tucking each of the plurality of signatures into a respective jaw device of a jaw cylinder using a respective tucking device corresponding to each gripper decelerator device, the jaw cylinder having a plurality of jaw devices.

11. The method as recited in claim 10 wherein the each respective tucking device is connected to its corresponding gripper decelerator device so as to move together with the corresponding gripper decelerator device.

12. The method as recited in claim 10 wherein the jaw cylinder and the gripper decelerator drum rotate so that a surface speed of the jaw cylinder substantially matches a speed of each tucking device at a point of transfer so as to assist the tucking.

13. The method as recited in claim 10 wherein the decelerating is performed on the plurality of signatures so that the plurality of signatures overlap prior to the folding step.

14. The method as recited in claim 10 wherein the plurality of gripper decelerator devices includes five gripper decelerator arms disposed around a circumference of the gripper decelerator drum.

15. The method as recited in claim 10 wherein each respective tucking device includes a tucking blade disposed a predetermined distance from the corresponding gripper decelerator device.

16. The method as recited in claim 10 wherein each of the plurality of signatures is decelerated by substantially 40%.

17. The method as recited in claim 13 further comprising releasing, using the plurality of jaw devices, the plurality of signatures in groups to at least two locations for subsequent folding operations.

18. The method as recited in claim 13 further comprising releasing, using the plurality of jaw devices, the plurality of signatures in groups for chopping in the groups.

* * * * *